United States Patent [19]

Giordano

[11] 4,142,370

[45] Mar. 6, 1979

[54] SNAP-ON END CAP FOR GUTTERS AND PROCESS FOR APPLYING SAME

[76] Inventor: Louis G. Giordano, 220 E. Arlington Ave., Linwood, N.J. 08221

[21] Appl. No.: 859,841

[22] Filed: Dec. 12, 1977

[51] Int. Cl.[2] ..... E04D 13/00

[52] U.S. Cl. ..... 405/119; 52/11

[58] Field of Search ..... 52/11-16; 61/14, 15; 285/DIG. 2, DIG. 16, DIG. 22; 138/89; 220/306, 315, 352-358

[56] References Cited

U.S. PATENT DOCUMENTS

| | | | |
|---|---|---|---|
| 1,460,733 | 7/1923 | Rigby | 61/15 |
| 3,300,911 | 1/1967 | Riddell | 52/16 |
| 3,440,778 | 4/1969 | Miles et al. | 52/11 |
| 3,612,453 | 10/1971 | Zimmer | 52/11 X |
| 3,809,412 | 5/1974 | Glover | 285/DIG. 16 X |
| 4,067,534 | 1/1978 | Frey | 285/DIG. 16 X |

*Primary Examiner*—J. Karl Bell

[57] ABSTRACT

A unitary plastic molded snap-on end cap for gutters constitutes a vertical end wall having a pair of flanges projecting outwardly normally about the periphery of the end wall from both sides thereof so that the same molded article may be used to cap either left-hand or right-hand open ends of gutters. Positive engagement of the gutter and the cap is provided by forming a groove in the cap having a rib which engages a projection formed on the gutter wall before the cap is applied thereto.

5 Claims, 9 Drawing Figures

SNAP-ON END CAP FOR GUTTERS AND PROCESS FOR APPLYING SAME

BRIEF SUMMARY OF INVENTION

It is customary trade practice to cap the open ends of sheet metal gutters using stamped metal caps which are formed with recesses therein to accept the end of the gutter. Normally, the recess in the cap is charged with a mastic sealer, the cap is placed over the end of the gutter and driven on until the end of the gutter fully enters the recess, and then cap and the gutter are riveted or crimped together.

Since gutters may require capping at either open end, it is necessary to maintain an inventory of left-hand and right-hand end caps.

The present invention provides an end cap which may be used with equal facility for either left-hand or right-hand closures, and does not require post-application crimping or riveting or the like, thereby permitting reduction in inventories and facilitating on-site capping. Improved sealing is obtained, and the use of sealing mastic may be eliminated.

DETAILED DESCRIPTION

A detailed description of a preferred embodiment of the invention is set forth hereinafter in conjunction with the accompanying drawings which form a part hereof, like numerals being used to refer to like parts throughout.

Figure 1:
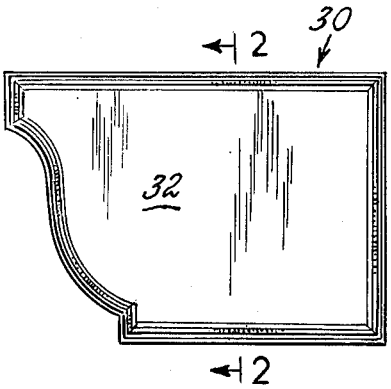
FIG. 1 is an outside end view, in elevation, of an end cap of the instant invention installed on an aluminum gutter of conventional five-inch box style.
Figure 2:
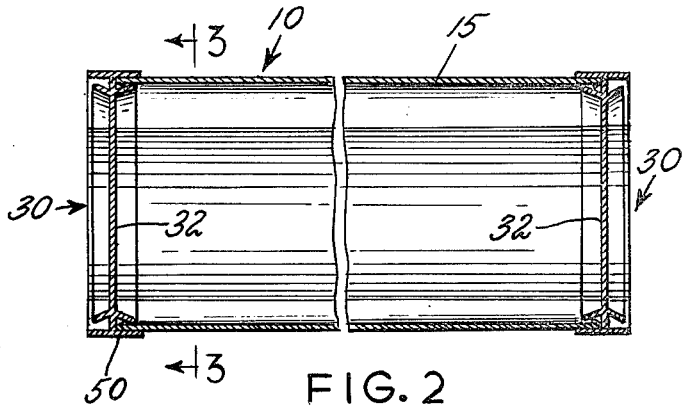
FIG. 2 is a top view of the end cap and gutter of FIG. 1 taken along the line 2—2 thereof and showing an end cap applied to both ends of the gutter.
Figure 3:
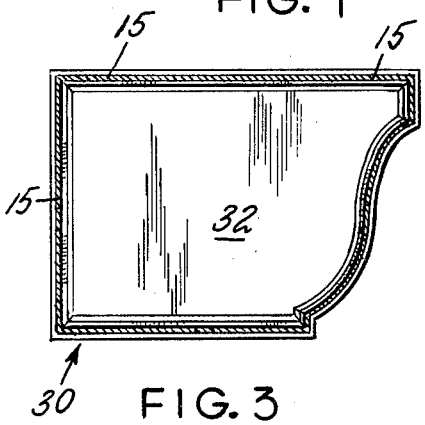
FIG. 3 is an inside end view, in elevation, of the end cap and aluminum gutter of FIG. 1 taken along the line 3—3 of FIG. 2.
Figure 4:
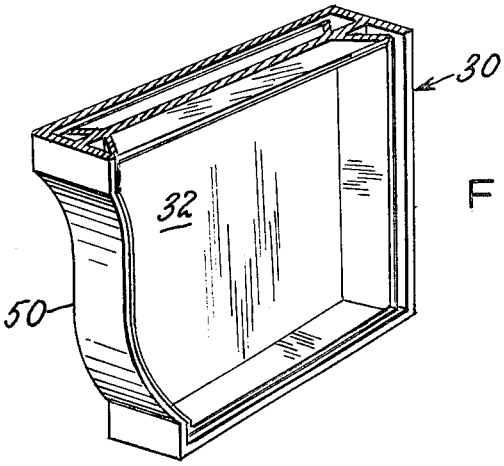
FIG. 4 is a view in perspective of the end cap of FIGS. 1-3.
Figure 5:
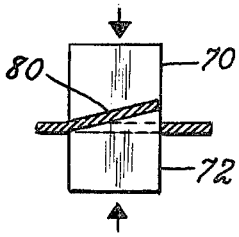
FIG. 5 illustrates the puncturing of the wall of the gutter in preparation for the application of the end cap thereto.
Figure 8:
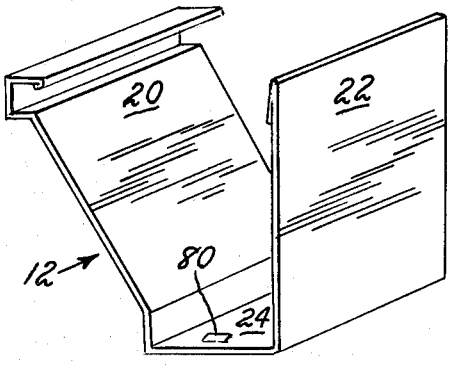
FIGS. 8 and 9 illustrate in perspective alternate gutter styles which may be used with the end cap of the invention.
Figure 6:
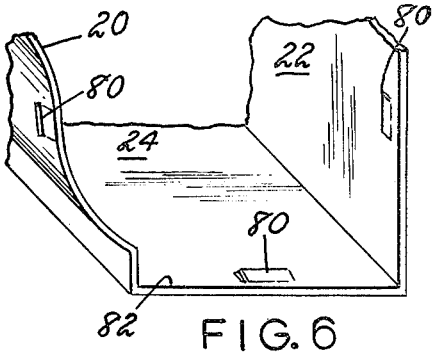
FIG. 6 illustrates in fragmentary perspective details of the disposition of projections about the wall of the gutter which insure positive interlocking between the snap-on end cap and the gutter.
Figure 9:
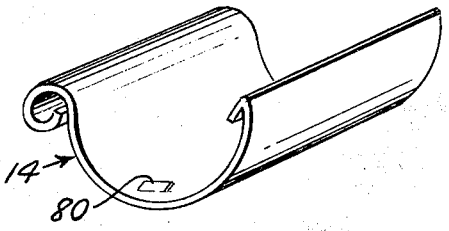

Referring now to the figures of the drawings, the end cap of the invention may readily be used with gutters of the conventional box style 10, K-style 12, or half round profile 14.

Normally metal gutters are open-topped, and may be formed from continuous lengths of thin, relatively rigid sheet material such as aluminum and galvanized steel. Gutters may also be formed of rigid polyvinylchloride and the like.

The gutters illustrated in the figures of the drawings have generally vertical front and back walls 20 and 22 and a horizontal substantially flat or arced bottom 24.

As shown by FIGS. 1-3 and 7, the open end of a gutter 10 is sealed by the instant snap-on end cap 30, which is a unitary injection molding of resilient polyethylene pigmented white with titanium dioxide and stabilized against ultraviolet by screening agents.

The end cap 30 is of the same profile as the gutter 10 with which it is to be employed, and has a vertical end wall 32 which corresponds in contour to the profile of the gutter 10.

Centrally transversely disposed about the periphery of the vertical end wall 32 are two opposed pairs of substantially normally extending flanges 50, 52 and 50, 54, each of which pairs of flanges defines therebetween a groove having the contour of the profile of the gutter 10.

The gutter flange 50 is transverse to the end wall 32, its inner face forming a snug friction fit with the outer surface of the wall of the gutter 10 by virtue of the resilient character of the polymer used to mold the end cap 30.

Figure 7:
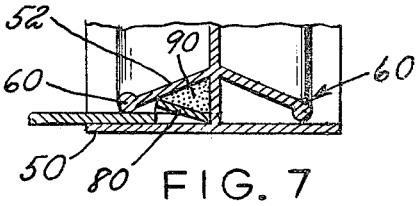
FIG. 7 is a detailed fragmentary view showing the positive interlocking engagement between the wall of the gutter and the snap-on end cap of the invention.

The inner flanges 52 and 54 project outwardly from the end wall 32 substantially normally, being inclined at a slight angle towards the outer flange 50 along their outside tips. The inner flanges 52 and 54 terminate at their outer tips in a bead or rib 60 which forms a re-entrant groove structure and which is resiliently biased against the inner surface of the wall of the gutter 10, as best illustrated in FIG. 7.

The outer flange 50 extends outwardly from the end wall 32 slightly farther than do the bead-carrying inner flanges 52,54 to protect the beads and to insure good liquid-tight contact between the outer flange and the wall of the gutter being capped.

In use, the wall of a gutter to be capped is crimped between a pair of crimping blocks 70,72, to puncture and displace inwardly one or more projecting tabs 80 along the end 82 of the gutter, the free end of the tab being disposed away from the open gutter end. The tabs 80 are disposed with their inwardly-projecting free ends a distance from the end of the gutter corresponding to the length of the inner flanges 52 and 54 between the end wall 32 and the bead 60. The throat of the re-entrant groove is optionally charged with sealing mastic 90, and the end cap 30 is driven over the end of the gutter 10 such that one pair of flanges (50,52 in FIG. 7) accepts the end of the gutter wall and the bead 60 springs over the tabs 80, thereby positively locking the end cap and the gutter together.

As is apparent, the two pairs of flanges 50,52 and 50,54, are of mirror-image disposition, extending as they do from opposite faces of the end wall 32, and thus the end cap 30 may be used to seal either end of the gutter 10.

Although the preferred end cap illustrated has the flanged structure extending across the top of the end wall, it is possible to omit this portion of the flanged structure (as gutters are open at the top) if the reduced structural rigidity of the end cap is acceptable. The device may be molded out of a variety of flexible resilient materials, including polyvinylchloride, polyethylene, polypropylene, rubber, and the like, and preferably the device is prepared by injection molding or casting of plastisols.

What is claimed is:

1. A snap-on end cap for open-ended gutters comprising a vertical end wall having substantially the contour of the profile of the gutter to be capped, said end wall having two opposed pairs of flanges projecting substantially normally outwardly therefrom about the periphery thereof, said pairs of flanges forming respectively, in mirror image relationship to each other on opposed sides of said end wall, a left-hand-mating ribbed groove and a right-hand-mating ribbed groove, said grooves corresponding in contour to the profile of said gutter, said end wall and flanges being a unitary resilient molding, whereby said snap-on end cap may with equal facility be applied to cap and seal either the left-hand or the right-hand open end of said gutter.

2. A snap-on end cap as set forth in claim 1 in which one flange in each pair of flanges has an outwardly projecting tip carrying an enlargement thereon whereby said enlargement may engage positively with a projection formed in the wall of said gutter near the open end thereof.

3. A snap-on end cap as set forth in claim 1 in which two pairs of flanges pass completely circumferentially around said end wall, whereby said end wall is strengthened against lateral flexure.

4. A snap-on end cap as set forth in claim 2 in which said enlargement is a bead carried on the inner flange of each pair of flanges.

5. A snap-on end cap as set forth in claim 4 in which said inner flange is shorter than the outer flange in each pair of flanges.

* * * * *